United States Patent [19]

Albrecht

[11] 4,280,785

[45] Jul. 28, 1981

[54] MULTI-DIRECTIONAL LIFTING AND HANDLING ATTACHMENT FOR A CRANE BOOM

[75] Inventor: Robert G. Albrecht, Shingle Springs, Calif.

[73] Assignee: Wismer & Becker Contracting Engineers, Sacramento, Calif.

[21] Appl. No.: 37,487

[22] Filed: May 9, 1979

[51] Int. Cl.[3] ..... B66C 1/00; B66C 1/18

[52] U.S. Cl. ..... 414/735; 294/74; 414/10; 414/23; 414/743

[58] Field of Search ..... 414/4, 10, 23, 910, 414/705, 738, 735, 732, 729, 743; 294/74

[56] References Cited

U.S. PATENT DOCUMENTS

| | | | |
|---|---|---|---|
| 2,634,826 | 5/1953 | Welden | 414/732 |
| 3,112,037 | 11/1963 | Thiermann | 414/23 |
| 3,272,347 | 9/1966 | Lemelson | 414/735 X |

*Primary Examiner*—Robert B. Reeves
*Assistant Examiner*—Douglas D. Watts
*Attorney, Agent, or Firm*—Lothrop & West

[57] ABSTRACT

A pipe, beam or other work piece is detachably secured to a handling device affixed to the extremity of a conventional telescoping crane boom, the handling device including a main frame, a sub-frame, and a work piece support frame. Respective hydraulic actuators selectively position the sub-frame relative to the main frame and the support frame relative to the sub-frame. One actuator rotates the sub-frame about a transverse axis and the other actuator rotates the support frame about a longitudinal axis. The work piece supporting frame includes means for detachably holding a work piece during handling periods, permitting the work piece to be positioned at any desired attitude, orientation and elevation by appropriate actuation of the hydraulic system.

1 Claim, 5 Drawing Figures

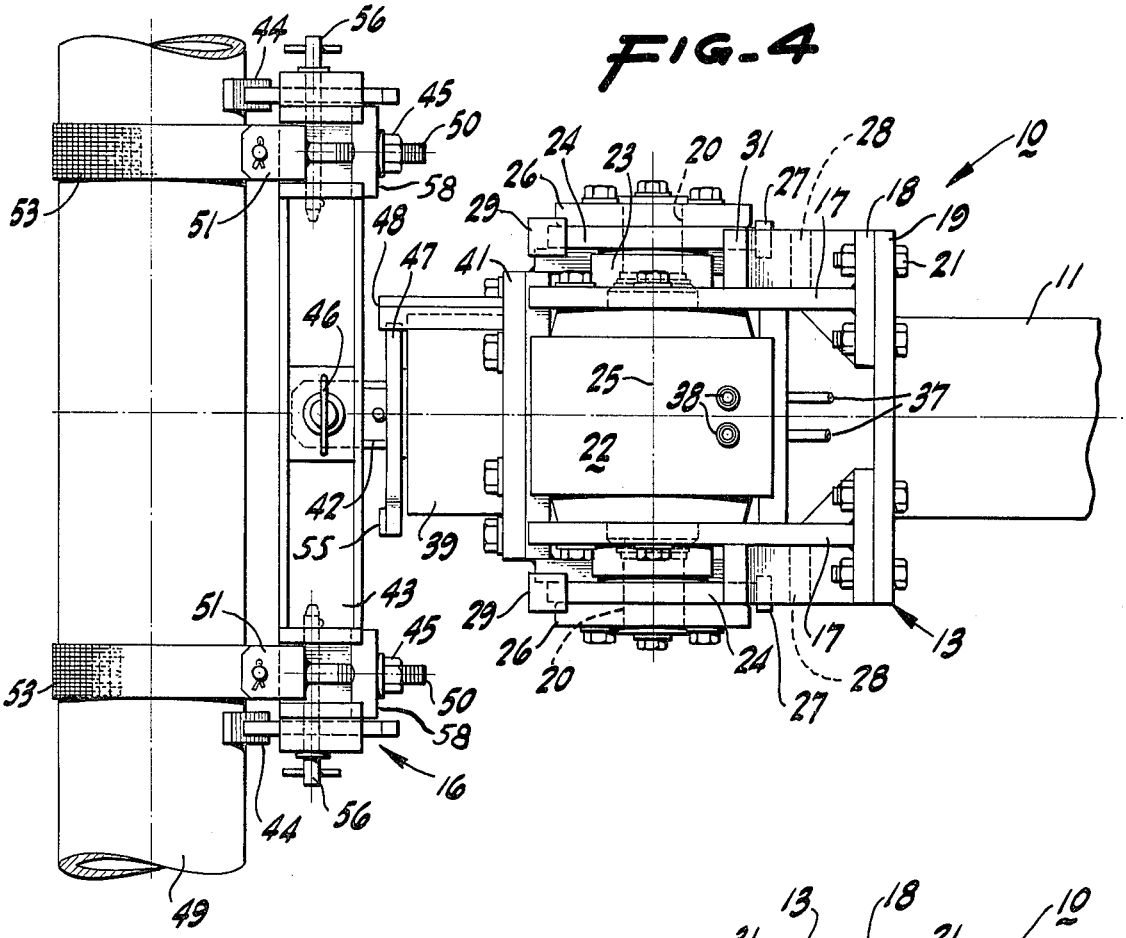
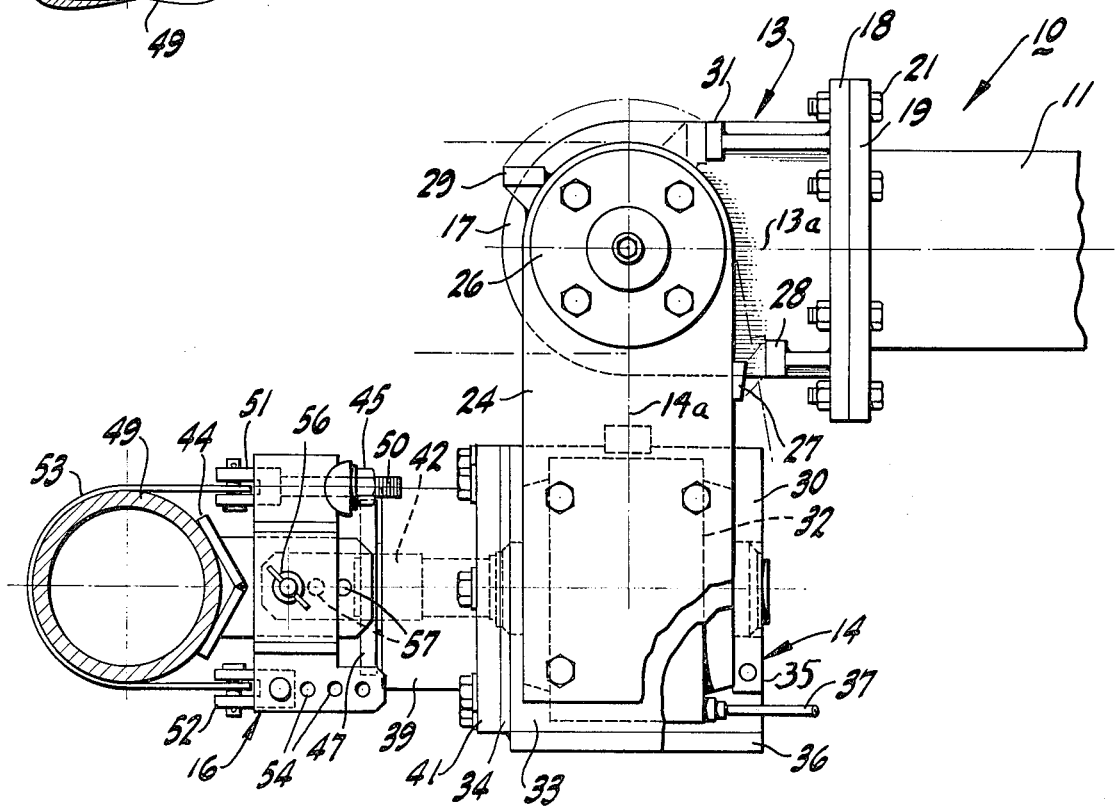
FIG-3

MULTI-DIRECTIONAL LIFTING AND HANDLING ATTACHMENT FOR A CRANE BOOM

CROSS-REFERENCES TO RELATED APPLICATION, IF ANY

None.

BACKGROUND OF THE INVENTION

During the construction of buildings, it is often necessary to transport and position heavy and awkward objects, such as pipes, beams, or the like. In some cases, a crane provided with a telescoping crane boom is well suited to accomplish the task, particularly where a motorized head has been placed on the end of the telescoping crane boom to afford rotational movement of the load about a longitudinal, generally fore and aft axis centered on the boom's end. However, even though motorized heads have added flexibility to the rather limited movement afforded by telescoping crane booms, limitations still exist.

The main limitation stems from the fact that the customary load or work piece is rigidly secured in a position such that its long dimension is perpendicular to the longitudinal axis of the telescoping crane boom. Since the longitudinal axis of the load cannot be changed with respect to the longitudinal axis of the crane boom, even though the boom is provided with a motorized head, forward movement of an elongated load into a narrow passageway, for instance, cannot be effected.

The present invention overcomes the deficiencies of the prior art by including an intermediate sub-frame between the main frame and the support framework. The sub-frame can pivot with respect to the main frame and the support framework can rotate with respect to the sub-frame in such manner as to permit the longitudinal axes of the telescoping crane boom and that of the load to be brought into parallelism. Hydraulic motors are preferably used to effect pivoting and rotation, thereby affording a nice degree of control and any desired alignment of the work piece.

SUMMARY OF THE INVENTION

A multi-directional lifting and handling device is mounted on the end of a standard telescoping crane boom. The elongated generally fore and aft main frame of the device includes a hydraulic rotary actuator which selectively rotates a pivotally connected sub-frame about a transverse, substantially horizontal axis. A cradle-like framework, in turn, is rotatably connected to the sub-frame and is selectively rotated by a second hydraulic acturator, the cradle-like framework being rotatable about a longitudinal generally fore and aft axis. Work pieces, such as pipes, beams, or the like, are detachably secured in the cradle-like framework by flexible chain straps which form a U-shaped clamp about the work piece, the chain straps being easily attached to and detached from the load, facilitating quick loading and unloading of the object to be moved. Since support frames of different sizes can be readily interchanged, loads of varying sizes can be accommodated.

SHORT DESCRIPTION OF THE DRAWING FIGURES

FIG. 1 is a side elevational view of a typical mobile crane provided with an extensible telescoping boom, the boom having mounted on the distal end thereof a preferred embodiment of the attachment of the present invention, the attachment with a load supported thereby in transverse orientation being shown in lowered position in full line and with the load in elevated position being shown in broken line;

FIG. 3 is a fragmentary side elevational view, to an enlarged scale, of the attachment of the invention;

FIG. 4 is a top plan view thereof, with a portion of the work piece broken away to reduce the extent of the figure; and, FIG. 5 is a front elevational view thereof, with one portion of the work piece broken away to reduce the extent of the figure and another portion of the work piece broken away to show the limit stop structure on the work piece support frame.

DETAILED DESCRIPTION OF PREFERRED EMBODIMENT

Figure 1:
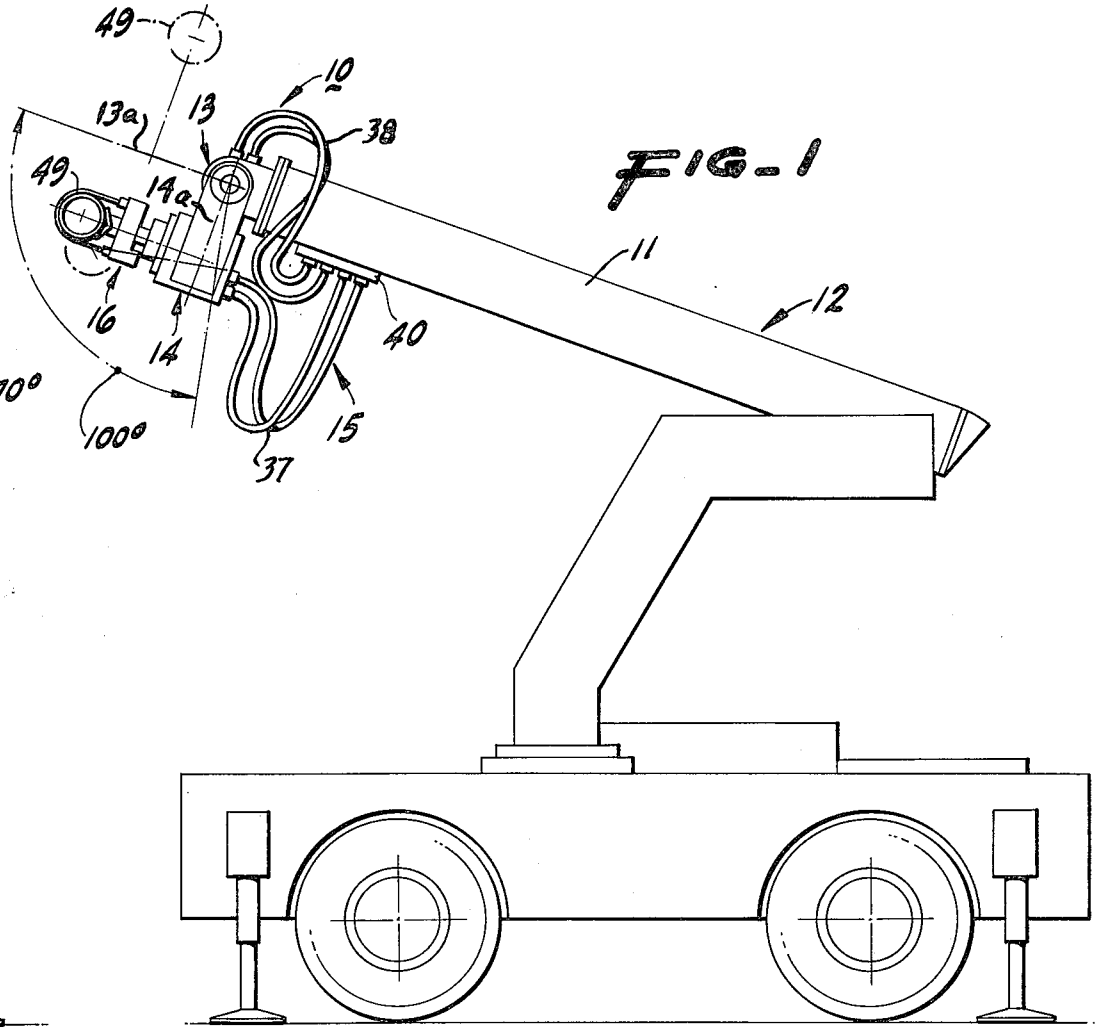

The multi-directional lifting and handling attachment of the invention, generally designated by the numeral 10, is joined to the distal end of a conventional telescoping boom 11 of a crane 12. The crane 12 includes a hydraulic system 15 of standard make and an appropriate arrangement of connecting fittings, gauges, controls and flexible conduits provide a source of regulated power to actuate hydraulic motors forming a part of the attachment, as will subsequently be described in detail. Conventional control valves, not shown, can be located at any convenient spot, enabling an operator to maneuver the crane and the attachment in the desired fashion.

The invention broadly comprises a main frame 13, a sub-frame 14, and a cradle-like load support framework 16.

As appears most clearly in FIGS. 3 and 4, the main frame 13 includes two parallel main frame support arms 17 mounted on, and extending in a generally fore and aft direction perpendicular to, a pair of rectangular transverse main frame flanges 18. The flanges 18 are coupled to a square transverse flange 19 on the end of the boom by a plurality of flange bolts 21. The main frame 13 is thereby rigidly secured to the distal end of the telescoping boom 11.

The sub-frame 14 is rotatable relative to the main frame 13 and rotates about a transverse, substantially horizontal axis 25. A first hydraulic actuator 22 is positioned transverse the main frame 13, being supported by and between the two support arms 17. A drive shaft 20 extending from opposite ends of the actuator 22 is journaled in a pair of bearings 23 on the outer sides of two main frame support arms 17 and is rotatable by the actuator on the axis 25, the shaft 20 carrying with it a pair of parallel support arms 24 mounted on the outer ends of the shaft 20, a splined plate 26 securing each of the arms 24 to the protruding ends of the shaft.

The shaft 20 is capable of rotating in either a clockwise or a counter-clockwise fashion about the transverse axis 25, causing the sub-frame 14 and the load supporting framework 16 to rotate in unison with the shaft from a first extreme, lowered, position to a second extreme, elevated, position, as appears in FIG. 1, the movement covering approximately 100° of arc.

In the first extreme lowered position of the arms 24 is a pair of tapered lower stop pads 27 on the arms 24 is in engagement with a respective pair of lower limit stops 28 mounted on flanges 18 of the main frame 13. The lower stop pads 27 and the lower limit stops 28, prevent the sub-frame 14 from rotating into, and perhaps damaging, the lower portion of the main frame flange 18. In this first extreme lowered position, the acute angle between the longitudinal axis 14*a* of the substantially vertical sub-frame 14 and the longitudinal axis 13*a* of the substantially horizontal main frame 13 is approximately 80° .In FIG. 3, the subtended angle is shown as being approximately 90° . with the result that the tapered lower stop pads 27 are shown as being somewhat separated from the lower limit stops 28. As appears in FIG. 3, counter-clockwise movement of the arms 24 for an angular distance of 10° would bring the lower stop pads 27 into abutment with the lower limit stops 28 and halt further counter-clockwise travel of the arms 24 and the sub-frame 14 carried thereon.

In the second extreme, or elevated, position, the sub-frame 14 is rotated outwardly and upwardly with respect to the main frame 13 until a pair of upper stop pads 29 (see FIGS. 3 and 4) on the arms 24 comes in contact with a respective pair of upper limit stops 31 projecting from the flanges 18 of the main frame 13. The placement of the upper stop pads 29 and the upper limit stops 31 is such that when the upper stop pads 29 are in engagement with the upper limit stops 31, the respective longitudinal axes 14*a* and 13*a* of the sub-frame 14 and the main frame 13 are in substantial alignment (see FIG. 1). Thus the arc through which the sub-frame 14 can rotate about the main frame 13 is approximately 100° , as shown in FIG. 1. The limitation on upward rotation of the sub-frame 14 provided by the upper stop pads 29 and respective upper limit stops 31 prevents damage to the main frame 13 and the sub-frame 14.

A second hydraulic actuator 32, as illustrated in FIG. 3, is mounted between the sub-frame support arms 24 in a box-like housing 30. A pair of side plates 33, a front plate 34, a rear plate 35, and a bottom plate 36 comprise the housing 30 which is bolted securely to the arms 24 and thus serves to strengthen and rigidify the sub-frame 14.

Pairs of hydraulic lines 37 and 38 are connected to the second hydraulic actuator 32 and first hydraulic actuator 22, respectively, the lines extending through a fitting 40 on the boom 11 and along the interior of the boom to connect with the hydraulic service system (not shown) on the crane chassis. The hydraulic service system is conventional, including valves, gauges and the usual controls.

A bearing housing 39 and a flange 41 are positioned on the center of the front plate 34 of the box-like housing 30 and serve to support the cradle-like framework 16 in which the work piece is held. A square in section drive shaft 42 protrudes from the center of the bearing housing 39 and is connected to the hydraulic actuator 32. The drive shaft 42 is rotated by the hydraulic actuator, 32, and when the support arms 24 of the sub-frame 14 are in a generally vertical attitude, as appears in full line in FIG. 1, the axis of rotation of the shaft 42 is generally fore and aft.

The support framework 16 comprises an elongated transverse yoke 43 and a pair of V-shaped in section clamping plates 44 (see FIGS. 3 and 4). Hitch pin 46, shown in FIG. 4, secures the yoke 43 to the square drive shaft 42. Support frameworks 16 of varying sizes and kinds can easily be mounted on drive shaft 42 by removing and reinserting the hitch pin 46.

Figure 5:
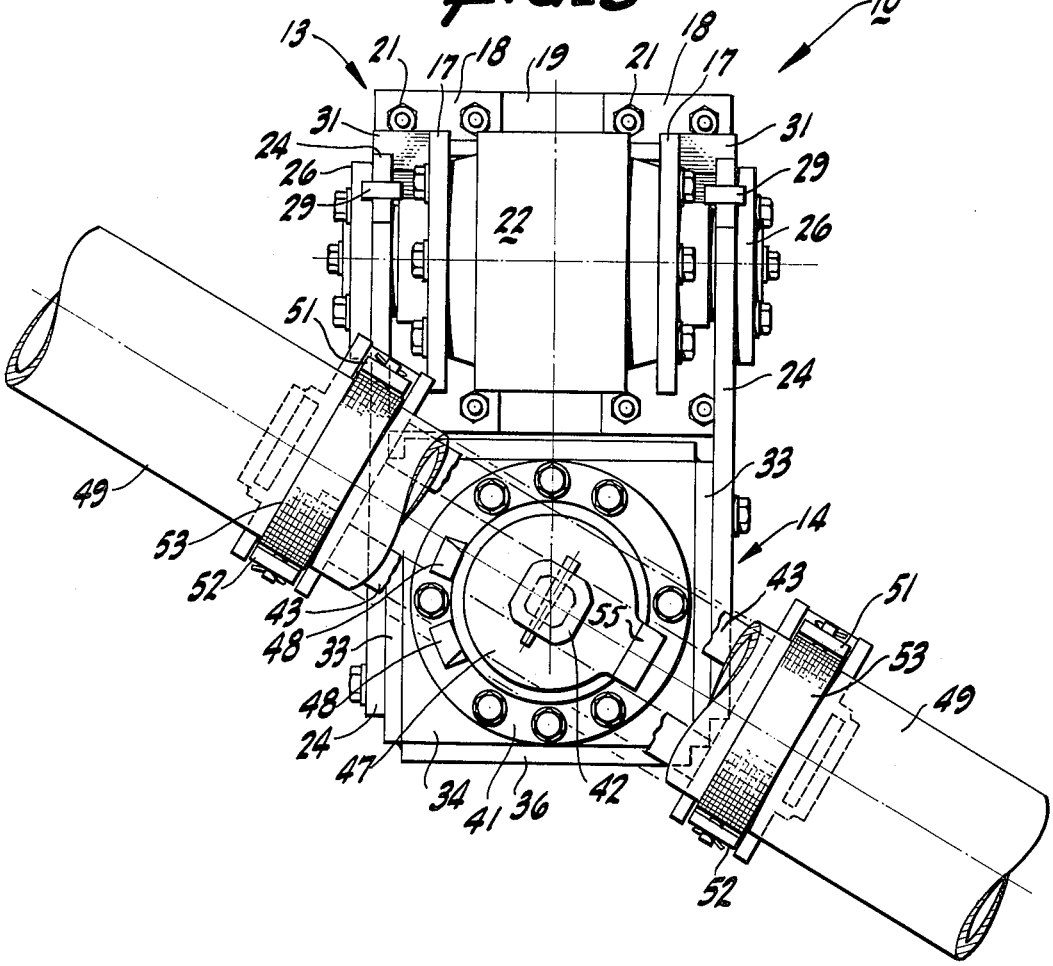

Rotational travel of the shaft 42 and the support framework 16 connected therewith, is limited by interference between a lug 55 on a stop plate 47 and two arcuately spaced stops 48. As can be seen most clearly in FIG. 5, the stop plate 47 is mounted on the shaft 42 and restricts the shaft's rotational movement to the 270° arc defined by the two stops 48 affixed to the bearing housing 39. In other words, the lug 55 projecting radially from the stop plate 47 impinges against the upper surface of the upper stop 48 in one extreme position and against the lower surface of the lower stop 48 in the other extreme position. A load 49, or work piece, can therefore be positioned at any desired angular position throughout the 270° arc shown in FIG. 2.

The load 49, or work piece, which may be a pipe, beam, or the like, is lodged in the cradle-like support formed by the V-shaped in section clamp plates 44, or backing plates. A movable upper clevis 51, a fixed lower clevis 52 and an intermediate flexible band 53 comprises means to hold the load 49 securely in position. A plurality of clevis adjustment holes 54 (see FIG. 3) permits loads of varying sizes and shapes to be accommodated by the support framework 16. Tightening of the flexible band 53 is effected by taking up on a pair of nuts 45 in threaded engagement with respective bolts 50 extending rearwardly from the movable upper clevises 5, the nuts bearing against transverse thrust bars 58 adjacent the ends of the transverse yoke 43.

Quick release end pins 56 permit fore and aft adjustment of the clamp plates 44 through register in a plurality of adjustment holes 57 as seen in FIG. 3, thereby facilitating the movement of the entire load in a fore and aft direction.

Figure 2:
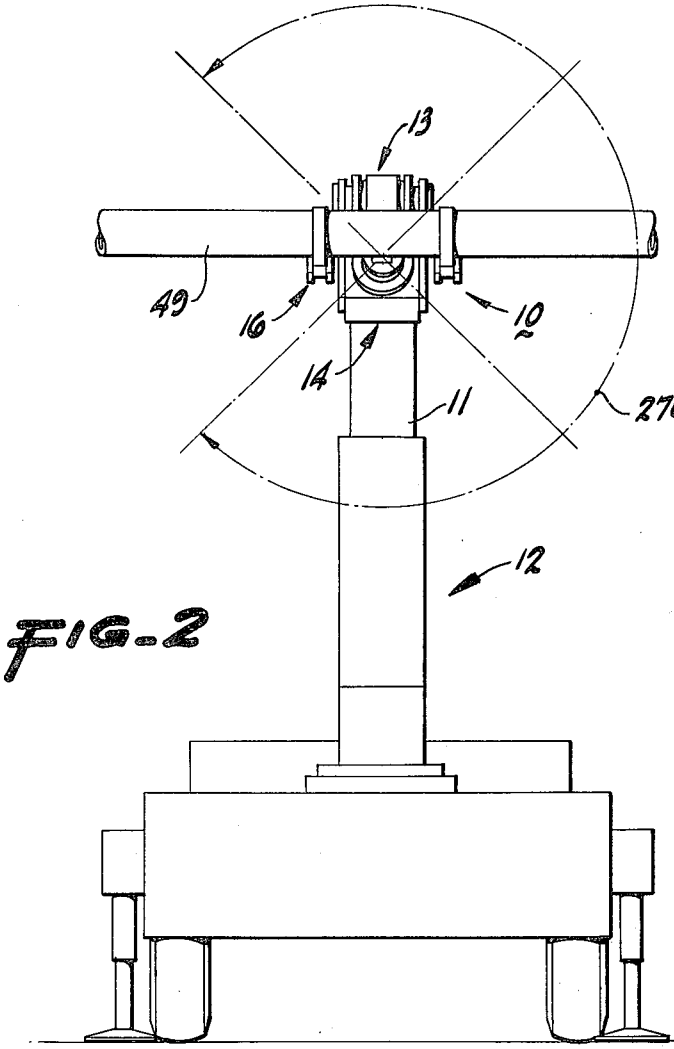
FIG. 2 is an elevational view of the left-hand end of the crane and attachement shown in FIG. 1, with a work piece in horizontal position shown in full line and the remaining positions by the arc indicated by the arrows.

With particular reference to FIGS. 1 and 2, it can be seen that once the load 49 is secured in the supporting framework, ordinarily in horizontal position initially, the load can be elevated to any desired height, within the capability of the crane boom, and either held in horizontal attitude or unloaded. If it is desired, the load can be rotated, through 90° , for example, into vertical attitude where it can be held while being welded or otherwise secured to a similar vertical member.

Should it be necessary to orient the load, such as a beam or a pipe, in a fore and aft direction, the sub-frame 14 is first swung upwardly so that the load 49 assumes the position shown in broken line in FIG. 1. Then, with the sub-frame 14 in upper position, the support frame shaft 42 is rotated 90° , or until the load is aligned into the vertical plane of the boom. At this juncture, with the load in a generally fore and aft orientation, the boom can be extended, passing the load into a narrow fore and aft passageway or opening.

Numerous other attitudes and orientations of the load can readily be effected by a skilled operator owing to the various types of freedom of motion afforded by the preferred embodiment of the crane boom attachment disclosed herein.

It can therefore be seen that the attachment of the invention converts a conventional crane into a versatile piece of equipment capable of handling a wide variety of loads in a highly maneuverable, safe and expeditious manner. I claim:

1. A multi-directional lifting and handling attachment for a crane boom comprising:

a. an elongated main frame;

b. means for mounting said main frame on the crane boom;

c. an elongated sub-frame pivotally connected to said main frame for rotation of said sub-frame about an axis transverse to the longitudinal axis of said main frame;

d. a work piece supporting frame rotatably connected to said sub-frame for rotation of said work piece supporting frame about an axis located substantially in a vertical plane including the longitudinal axis of said main frame;

e. gripping means on said work piece supporting frame for removably securing an elongated work piece on said work piece supporting frame, said gripping means including an elongated cradle and at least one U-shaped flexible band selectively adjustable so as to secure elongated work pieces of different transverse dimensions positioned in said cradle;

f. first hydraulic actuator means for selectively moving said sub-frame relative to said main frame by rotating said sub-frame about said transverse axis;

g. second hydraulic actuator means for moving said work piece supporting frame relative to said sub-frame by rotating said work piece supporting frame about said axis vertically coplanar with the longitudinal axis of said main frame; and, h. cooperating limit stop and stop pad means on said main frame and said sub-frame, respectively, for limiting the extent of rotational movement of said sub-frame relative to said main frame about said transverse axis to a predetermined arc.

* * * * *